US006918975B2

(12) United States Patent
Liu et al.

(10) Patent No.: US 6,918,975 B2
(45) Date of Patent: Jul. 19, 2005

(54) ALUMINUM ALLOY EXTRUSIONS HAVING A SUBSTANTIALLY UNRECRYSTALLIZED STRUCTURE

(75) Inventors: John Liu, Lower Burrell, PA (US); Gary H. Bray, Murrysville, PA (US); David A. Lukasak, Lafayette, IN (US); Robert C. Pahl, West Lafayette, IN (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/821,291

(22) Filed: Mar. 29, 2001

(65) Prior Publication Data

US 2001/0020501 A1 Sep. 13, 2001

Related U.S. Application Data

(62) Division of application No. 09/231,135, filed on Jan. 15, 1999, now Pat. No. 6,325,869.

(51) Int. Cl.[7] ..... C22F 1/057
(52) U.S. Cl. ..... 148/690; 148/700
(58) Field of Search ..... 148/690, 700

(56) References Cited

U.S. PATENT DOCUMENTS 4,294,625 A 10/1981 Hyatt et al. ..... 148/2
4,323,399 A * 4/1982 Dubost et al. ..... 148/690
4,336,075 A 6/1982 Quist et al. ..... 148/2
5,213,639 A 5/1993 Colvin et al. ..... 148/693
5,273,594 A * 12/1993 Cassada ..... 148/700
5,863,359 A 1/1999 Karabin et al. ..... 420/533
5,865,914 A * 2/1999 Karabin et al. ..... 148/693
6,325,869 B1 * 12/2001 Liu et al. ..... 148/439

* cited by examiner

*Primary Examiner*—George Wyszomierski
(74) *Attorney, Agent, or Firm*—D. Mark Maloney; Eckert Seamans Cherin & Mellott, LLC

(57) ABSTRACT

A substantially unrecrystallized extrusion comprising about 3.6 to about 4.2 wt. % copper, about 1.0 to about 1.6 wt. % magnesium, about 0.3 to about 0.8 wt. % manganese, about 0.05 to 0.25% zirconium, the balance substantially aluminum, incidental elements and impurities. The extrusion has a longitudinal yield strength of at least about 50 ksi and a longitudinal tensile ultimate strength of at least about 70 ksi. On a preferred basis, the extrusions of this invention include very low levels of both iron and silicon, typically on the order of less than 0.1 wt. % each, and more preferably about 0.05 wt. % or less iron and about 0.03 wt. % or less silicon.

12 Claims, 3 Drawing Sheets

ALUMINUM ALLOY EXTRUSIONS HAVING A SUBSTANTIALLY UNRECRYSTALLIZED STRUCTURE

This application is a division of 09/231,135 filed Jan. 15, 1999 now Pat. No. 6,325,869.

FIELD OF THE INVENTION

This invention pertains to an aluminum alloy substantially unrecrystallized structure. More specifically, the invention pertains to 2XXX series aluminum alloys and methods of making 2XXX series alloys which have a substantially unrecrystallized structure.

BACKGROUND OF THE INVENTION

A significant economic factor in operating aircraft today is the cost of fuel. As a consequence, aircraft designers and manufacturers are constantly striving to improve the overall fuel efficiency. One way to increase fuel efficiency, as well as overall airplane performance, is to reduce the structural weight of the airplane. Since aluminum alloys are used in a large number of the structural components of most aircraft, significant efforts have been expended to develop aluminum alloys that have higher strength-to-weight ratios than the alloys in current use, while maintaining the same or higher fracture toughness, fatigue crack growth resistance, high cycle fatigue resistance and corrosion resistance.

For example, one extrusion alloy currently used as stringers on the lower wing skins of some commercial jet aircraft is alloy 2024 in the T3511 temper. Alloy 2024-T3511 has a relatively high fracture toughness, good high cycle fatigue resistance, very high resistance to fatigue crack growth, and adequate strength and corrosion resistance. Another currently available alloy sometimes used on commercial jet aircraft for upper wing applications is alloy 7075-T6511. Alloy 7075-T6511 is stronger than alloy 2024-T3511; however, alloy 7075-T6511 is inferior to alloy 2024-T3511 in fracture toughness and fatigue crack growth resistance. Thus, the higher strength-to-weight ratio of alloy 7075-T6511 often cannot be used advantageously without sacrificing fracture toughness and/or fatigue performance of the component on which it is desired to use the alloy. Likewise, other currently available alloys in their various tempers, for example, alloys 7175-T6511, 7175-T76511, 7175-T73511, 7050-T76511, 7050-T74511, and 2024-T8511, although sometimes exhibiting good strength or fracture toughness properties and/or high resistance to stress corrosion cracking and exfoliation corrosion, do not offer the combination of improved strength, fracture toughness and fatigue properties over alloy 2024-T3511 for lower wing applications. Thus, with currently available alloys in various tempers, it is usually impossible to achieve weight savings in aircraft lower wing structural components presently fabricated from alloy 2024-T3511 while maintaining fracture toughness, fatigue crack growth resistance and corrosion resistance at or above the current levels.

It is therefore an object of the present invention to provide an aluminum extrusion alloy for use in structural components of aircraft that has a higher strength-to-weight ratio than the currently available alloy 2024-T3511. It is a further object of the present invention to provide this aluminum alloy extrusion with improved fatigue and fracture toughness properties while maintaining stress corrosion resistance and exfoliation corrosion resistance at a level approximately equivalent to that of alloy 2024-T3511.

The microstructure of the alloy is important to obtaining the desired strength properties. It is desired to produce a 2XXX alloy having higher strength than is currently available. In addition, it is desirable to extrude the alloy as quickly as possible for higher productivity.

Accordingly, it would be advantageous to provide a 2XXX alloy having a substantially unrecrystallized structure.

The primary object of the present invention is to provide a method and 2XXX alloy having a substantially unrecrystallized structure.

Another objective of the present invention is to provide a method of extruding a 2XXX alloy having a substantially unrecrystallized structure.

Yet another object of the present invention is to provide a method of extruding a 2XXX alloy having a substantially unrecrystallized structure which permits the use of higher extrusion speeds than is currently used for 2XXX alloys.

Another object of the present invention is to provide 2XXX alloy with improved extrusion press productivity without decreasing the commercial quality of the product that is being extruded. The commercial quality of the extruded product is evaluated in terms of tensile and yield strengths and grain structure.

Yet another object of the present invention is to provide a 2XXX aluminum alloy which can be extruded at the highest possible extrusion speeds without loss of extruded product due to physical defects.

Still another objective of the present invention is to provide a 2XXX aluminum alloy which can be extruded at the highest possible extrusion speeds for a wide variety of shapes and sizes.

These and other objects and advantages of the present invention will be more fully understood and appreciated with reference to the following description.

SUMMARY OF THE INVENTION

The present invention is a 2000 series aluminum alloy product which outperforms its 2024 and 2224 alloy counterparts. An aspect of the invention is a substantially unrecrystallized extrusion comprising: about 3.6 to about 4.2 wt. % copper, about 1.0 to about 1.6 wt. % magnesium, about 0.3 to about 0.8 wt. % manganese, about 0.05 to about 0.25% zirconium, the balance substantially aluminum, incidental elements and impurities. The extrusion has a longitudinal yield strength of at least about 50 ksi, a longitudinal tensile ultimate strength of at least about 70 ksi, and an elongation of at least about 16%. On a preferred basis, the extrusions of this invention include very low levels of both iron and silicon, typically on the order of less than 0.1 wt. % each, and more preferably about 0.05 wt. % or less iron and about 0.03 wt. % or less silicon.

Another aspect of the invention is a method of extruding structural members comprising: (a) providing an alloy comprising: about 3.6 to about 4.2 wt. % copper, about 1.0 to about 1.6 wt. % magnesium, about 0.3 to about 0.8 wt. % manganese, about 0.05 to about 0.25% zirconium, the balance substantially aluminum, incidental elements and impurities; (b) extruding said alloy within about 500° to about 850° F. to form an extrusion; (c) solution heat treating said extrusion at more than about 900° F. and then quenching; and (d) stretching said extrusion before making a structural member therefrom.

Another aspect of the present invention is a substantially unrecrystallized extrusion comprising about 3.6 to about 4.2 wt. % copper, about 1.0 to about 1.6 wt. % magnesium, about 0.3 to about 0.8 wt. % manganese, about 0.05 to about 0.25% zirconium, the balance substantially aluminum, incidental elements and impurities. The substantially unrecrystallized extrusion has a longitudinal yield strength of at least about 50 ksi, a longitudinal tensile ultimate strength of at least about 70 ksi, and an elongation of at least about 16%.

BRIEF DESCRIPTION OF THE DRAWINGS

Other features of the present invention will be further described in the following related description of the preferred embodiment which is to be considered together with the accompanying drawings wherein like figures refer to like parts and further wherein.

DETAILED DESCRIPTION OF PREFERRED EMBODIMENTS

Figure 1:
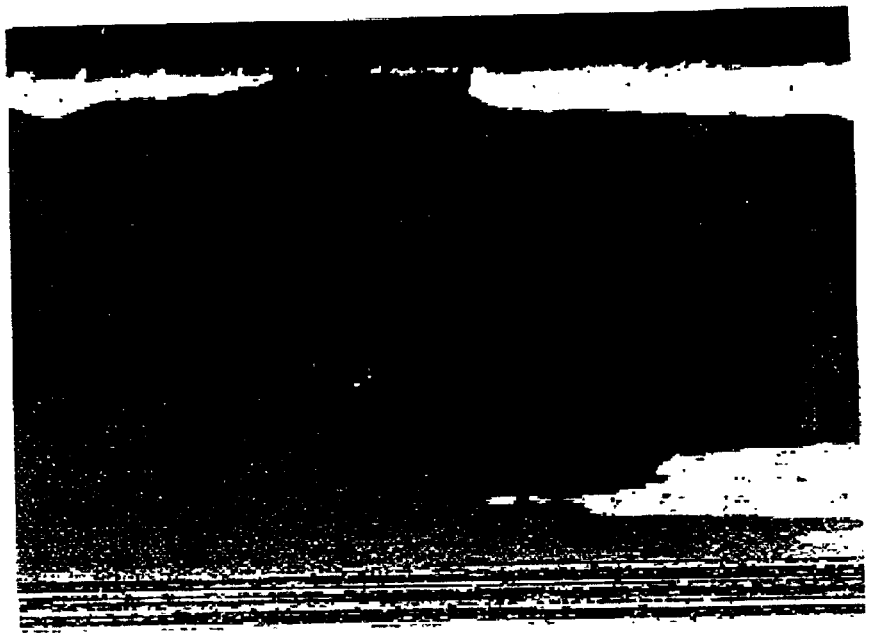
FIG. 1 is a photomicrograph of AA 2224-T3511 product extruded at 650° F.

For the description of preferred alloy compositions that follows, all percentage references are to weight percents (wt. %) unless otherwise indicated. All temper and alloy designations used herein are generally described in the *Aluminum Association Standards and Data* book, the pertinent disclosures of which are incorporated by reference herein.

The term "ksi" means kilopounds per square inch.

The term "minimum strength" or a minimum for another property or a maximum for a property refers to a level that can be guaranteed and can mean the level at which 99% of the product is expected to conform with 95% confidence using standard statistical methods; and, while typical strengths may tend to run a little higher than the minimum guaranteed levels associated with plant production, they at least serve to illustrate an invention's improvement in strength properties when compared to other typical values in the prior art.

The term "ingot-derived" means solidified from liquid metal by a known or subsequently developed casting processes and includes, but is not limited to, direct chill (DC) semi-continuous casting, electromagnetic casting (EMC) and variations thereof, as well as truly continuous cast slab and other ingot casting techniques.

By "substantially unrecrystallized", it is meant that the plate products of this invention are preferably 85 to 100% unrecrystallized, or at least 60% of the entire. thickness of said plate products are unrecrystallized.

The term "2XXX" or "2000 series", when referring to alloys, means those structural aluminum alloys with copper as the alloying element present in the greatest weight percent as defined by the Aluminum Association.

When referring to any numerical range of values herein, such ranges are understood to include each and every number, decimal and/or fraction between the stated range minimum and maximum. A range of about 3.6 to 4.2 wt. % copper, for example, would expressly include all intermediate values of about 3.61, 3.62 . . . 3.65 . . . 3.7 wt. %, and so on, all the way up to and including 4.1, 4.15 and 4.199 wt. % Cu. The same applies to all other elemental ranges, property values (including strength levels) and/or processing conditions (including aging temperatures) set forth herein.

The term "substantially-free" means having no significant amount of that component purposefully added to the composition to import a certain characteristic to that alloy, it being understood that trace amounts of incidental elements and/or impurities may sometimes find their way into a desired end product. For example, a substantially vanadium-free alloy should contain less than about 0.1 or 0.05% V, or more preferably less than about 0.03% V, due to contamination from incidental additives or through contact with certain processing and/or holding equipment. All preferred first embodiments of this invention are substantially vanadium-free. On a preferred basis, these same alloy products are also substantially free of lithium, bismuth, lead, cadmium, chromium, titanium and zinc.

The expression "consisting essentially of" is meant to allow for adding further elements that may even enhance the performance of the invention so long as such additions do not cause the resultant alloy to materially depart from the invention and its minimum properties as described herein and so long as such additions do not embrace prior art.

The high strength, high fatigue crack growth resistance and high cycle fatigue resistance, high fracture toughness and adequate corrosion resistance properties of the alloy of the present invention are dependent upon a chemical composition that is closely controlled within specific limits as set forth below, upon a carefully controlled heat treatment, and for extrusion products, upon a microstructure that is substantially unrecrystallized. If the composition limits, fabrication, thermomechanical processing, and heat treatment procedures required to produce the invention alloy stray from the limits set forth below, the desired combination of strength increase, fracture toughness increase and fatigue resistance improvement objectives will not be achieved.

The aluminum alloy of the present invention comprises about 3.6 to about 4.2 wt. % copper, about 1.0 to about 1.6 wt. % magnesium, about 0.3 to about 0.8 wt. % manganese, about 0.05 to about 0.25% zirconium, the balance substantially aluminum, incidental elements and impurities. For the trace and impurity elements zinc, titanium and chromium present in the invention alloy, the maximum allowable amount of zinc 0.25%, of titanium is 0.15%, and of chromium is 0.10%. For the impurity elements iron and silicon, the maximum allowable amount of iron is 0.08%, and of silicon is 0.06%.

The alloy of the present invention and the sales limits for similar alloy compositions are:

TABLE 1

| Designation | Si | Fe | Cu | Mn | Mg | Cr | Zn | Ti | Zr |
|---|---|---|---|---|---|---|---|---|---|
| 2024* | 0.50 | 0.50 | 3.8–4.9 | 0.30–0.9 | 1.2–1.8 | 0.10 | 0.25 | 0.15 | — |
| 2124* | 0.20 | 0.30 | 3.8–4.9 | 0.30–0.9 | 1.2–1.8 | 0.10 | 0.25 | 0.15 | — |
| 2224* | 0.12 | 0.15 | 3.8–4.4 | 0.30–0.9 | 1.2–1.8 | 0.10 | 0.25 | 0.15 | — |
| 2324* | 0.10 | 0.12 | 3.8–4.4 | 0.30–0.9 | 1.2–1.8 | 0.10 | 0.25 | 0.15 | — |
| Invention | 0.06 | 0.08 | 3.6–4.2 | 0.3–0.8 | 1.0–1.6 | 0.10 | 0.25 | 0.15 | 0.05–0.25 |

*Others: each 0.05, total 0.15

Note: Where a range is indicated, ⇒ min and max. Where a single number is indicated ⇒ max.

Conventional melting and casting procedures are employed to formulate the invention alloy. Care must be taken to maintain high purity in the aluminum and the alloying constituents so that the trace and impurity elements, especially iron and silicon, are at or below the requisite maximums. Ingots are produced from the alloy using conventional procedures such as semi-continuous direct chill casting. Once the ingot is formed, the invention alloy must not undergo a conventional homogenization, for example, by subjecting the ingot to elevated temperature of about 915° F. The conventional homogenization treatment, while entirely adequate for providing an essentially uniform distribution of alloying elements, results in a coarse distribution of dispersoids.

In similar 2XXX alloys, the alloying element Mn is mostly in supersaturation after ingot casting. During homogenization, Mn undergoes a solid state reaction and forms dispersoid particles of approximate stoichiometry $Al_{20}Cu_2Mn_3$. These dispersoids can inhibit recrystallization when present in high number density by pinning recrystallization nuclei in early stages of recrystallization via a metallurgical process called Zener drag. However, the conventional homogenization results in dispersoid distributions which are in general too coarse to inhibit recrystallization.

The invention alloy product is aimed at being substantially unrecrystallized. It addresses the above-described shortcomings of similar 2XXX alloys by the introduction of an additional dispersoid-forming element Zr, coupled with a well controlled homogenization treatment that balances the elemental redistribution while at the same time, provides a dense distribution of Mn-bearing dispersoids as well as an additional distribution of Zr-bearing dispersoids. The specially controlled homogenization is carried out by slowly heating the ingot over a course of about 9 hours (or longer) to a temperature between about 855° and 880° F. and is maintained therein for about 18 hours, followed by air cooling to room temperature.

Following the homogenization step, the alloys are cooled to room temperature at any desired rate. This cooling to room temperature is preferably air cooling. The alloys may be optionally cooled following homogenization to at least 800° F. (426.7° C.) at a rate of less than 100° F. (37.8° C.) per hour, preferably at a rate of less than 70° F. (21.1° C.) per hour. This optional slow cooling is followed by cooling of the alloys to room temperature at any desired rate. This cooling to room temperature is preferably air cooling.

After cooling the homogenized alloy to substantially room temperature, the ingot is sawed into billets of appropriate lengths and scalped. Then the billets may be reheated to an elevated temperature for extrusion. The reheat process can be carried out either by induction heating or in an air furnace. In the case of induction heating, the billet is rapidly heated to the desired extrusion temperature and extruded. The reheat temperature represents the optimum starting point for extruding the billet into the desired configuration based on producing commercially acceptable product and available press tonnage. The selection of a reheat temperature can have a major impact on the productivity and thus the profitability or an extrusion press. Reheating the billet to too low a temperature results in recrystallization during subsequent solution heat treatment and hence, lower or failing strength (depending on the specification). Reheating the billet to too high a temperature results in low extrusion speeds in order to produce acceptable product.

After the material has reached the reheat temperature, it is ready to be placed in the extrusion press and extruded. In an effort to avoid unnecessary cooling of the billet, care is taken to minimize the time it takes to transport the material from the reheat furnace to the extrusion press. The billet is placed into a heated compartment or container in the extrusion press. All of the foregoing steps relate to practices that are well known to those skilled in the art of casting and extruding. Each of the foregoing steps is related to metallurgical control of the metal to be extruded.

The billets can then be extruded. As will be described in more detail below, when hot working the alloy to produce extrusions, extreme care must be taken to prevent any substantial recrystallization or tearing of the extrusion surface. As stated above, the term "substantially unrecrystallized" means that less than about 20 vol. % of the alloy microstructure in a given product is in a recrystallized form, excepting surface layers of extrusions which often show complete recrystallization. In any event, the surface layers of extrusion products are often removed during fabrication into final part configurations. As will be described in more detail below, recrystallization (including the surface layer) can be minimized by maintaining the temperature of the alloy during hot working at levels that cause annealing out of internal strains produced by the working operation such that recrystallization will be minimized during the working operation itself, or during subsequent solution treatment.

After the alloy is extruded into a product, the product is typically solution heat treated at a temperature on the order of 920° F. for a time sufficient for solution effects to approach equilibrium. Once the solution effects have approached equilibrium, the product is quenched using conventional procedures, normally by spraying the product with or immersing the product in room temperature water. After quenching, extruded products may be stretched or stress relieved to develop adequate strength, relieve internal stresses and straighten the product.

Large intermetallic compounds formed during solidification, fabrication and heat treatment will lower the fracture toughness of the invention alloy. It is therefore most important to maintain the level of the elements which form intermetallic compounds at or below the allowable maximum set forth above. Intermetallic compounds may be formed from the major alloying elements copper, magnesium and manganese, as well as from impurity elements, such as iron and silicon. The amount of the major alloying element copper is constrained so that the maximum amount of this element will be taken into solid solution during the solution heat treatment procedure, while assuring that excess copper will not be present in sufficient quantities to cause the formation of any substantial volume of large, unwanted intermetallic particles containing this element. The amounts of the impurity elements iron and silicon are also restricted to the very low levels as previously indicated in order to prevent formation of substantial amounts of iron and silicon containing particles.

If the total of large intermetallic compounds formed by copper, magnesium, manganese, iron and silicon, such as $CuAl_2$, $CuMgAl_2$, $Al_{12}(Fe,Mn)_3Si$, $Al_7Cu_2Fe$ and $Mg_2Si$ in an alloy otherwise made in accordance with the present invention exceeds about 1.5 vol. % of the total alloy, the fracture toughness of the alloy will fall below the desired levels, and in fact may fall below the fracture toughness levels of similar prior art alloys of the 2024 type. The fracture toughness properties will be enhanced even further if the total volume fraction of such intermetallic compounds is within the range of from about 0.5 to about 1.0 volume percent of the total alloy. If the foregoing preferred range of intermetallic particles is maintained, the fracture toughness of the invention alloy will substantially exceed that of prior art alloys of similar strength.

The extrusion process involves a considerable amount of deformation energy. Most of this energy transforms into heat, but part of the deformation energy is stored in the material. The lower the extrusion temperature and/or the higher the extrusion speed, the higher the stored energy of deformation. The 2XXX alloys, as is the case with most aerospace aluminum alloys, require a solution heat treatment subsequent to extrusion, during which the stored energy of deformation is dissipated. For materials with a high stored energy, the stored energy dissipation manifests in the undesirable recrystallization.

Recrystallization causes the loss of the strengthening deformation texture built up during extrusion. It also changes the grain structure by replacing the low angle grain boundaries in the deformed or unrecrystallized state with high angle grain boundaries. The high angle grain boundaries are susceptible to heterogeneous. precipitation during the quenching operation of the subsequent solution heat treatment. The high angle grain boundaries with heterogeneous precipitates are weak links in fracture processes and preferred sites for anodic corrosion attack. A recrystallized 2XXX product, therefore, may fail to meet certain property specifications such as strength, toughness and corrosion resistance.

The extrusion procedure itself is controlled to minimize recrystallization in the final product and to thus maintain the strength and toughness of the product at the desired improved levels. U.S. Pat. No. 4,294,625 discloses that desired properties can be achieved if the alloy is extruded at temperatures at or above about 770° F. while holding the extrusion speed such that the degree of recrystallization in the final wrought product is minimized.

The extrusion conditions (speed and temperature) of hard aluminum alloys are determined empirically and kept below safe speed and temperature limits by experience to reduce the risk of impairing the quality and properties of the extruded product.

Exact extrusion speeds and temperatures are of course dependent upon such factors as starting billet size, extrusion size and shape, number of die openings, press tonnage and method of extrusion (direct or indirect). Unlike plate products, it is necessary to achieve a substantially unrecrystallized structure in the extruded product in order to obtain the desired mix of properties. The unrecrystallized structure thus produced is very beneficial to strength. An 8.8 (18%) ksi or greater differential has been noted between unrecrystallized and recrystallized structures of extrusions of the invention alloy. Likewise, the unrecrystallized structure is usually superior to its recrystallized counterpart in fracture toughness, as it is more difficult to propagate cracks in the finer unrecrystallized structure of the invention alloy in which the heterogeneously nucleated grain boundary precipitates are much finer.

Extruded products may be stretched as a final working procedure in order to straighten and strengthen the product and to remove residual quenching stresses from the product. It should be noted that the stress patterns in the cold worked invention alloy are reversed from those of normal solution treated and quenched material; i.e., the surface layers of the invention alloy are in tension and the center is in compression. Stretching a product of the invention alloy beyond 2% to 3% up to about 8% provides a continual increase in strength. Where such increased strength is not needed, extrusions are stretched 1% to 3%, as is normally required for all commercial alloys for aerospace applications.

The benefit of the present invention is illustrated in the following examples. The first example was performed for the purpose of comparison.

EXAMPLE 1

An ingot of 2224 was processed in accordance with conventional procedures. The ingot was scalped, homogenized, cooled to room temperature and then induction heated for extrusion. The extrusion temperature was selected in accordance with standard practice to avoid recrystallization. The extrusions were then solution heat treated at about 920° F. for 30 minutes to 2 hours, depending on thickness, and quenched with room temperature water. The extrusions were then stretched by amounts varying from 1% to 3% in the extrusion direction to minimize residual quenching stresses. Yield strength, ultimate tensile strength and percent elongation tests were then run on specimens taken from the extruded product. The data from these tests are reported in Table 2 below.

TABLE 2

| | | Preheat Practice | | Extrusion Billet | TYS | UTS | % |
|---|---|---|---|---|---|---|---|
| Example | Alloy | (temp. ° F.) | (hrs.) | Temp (° F.) | (ksi) | (ksi) | Elong. |
| 1 | 2224 | 915–935 | 24 | 720 | 57.6 | 76.9 | 15.7 |
| 2 | Invention | 855–880 | 18 | 650 | 55.0 | 75.4 | 17.9 |

TABLE 2-continued

| Example | Alloy | Preheat Practice (temp. ° F.) | Preheat Practice (hrs.) | Extrusion Billet Temp (° F.) | TYS (ksi) | UTS (ksi) | % Elong. |
|---|---|---|---|---|---|---|---|
| 3 | Invention | 855–880 | 18 | 650 | 54.2 | 74.3 | 16.0 |
| 4 | Invention | 855–880 | 18 | 600 | 55.4 | 75.7 | 17.6 |

EXAMPLES 2 AND 3

The procedure of Example 1 was repeated with the alloy of the present invention with the exception that the preheat temperature was as shown in Table 2 and the extrusion temperature was 650° F. Yield strength, ultimate tensile strength and percent elongation tests were then run on specimens taken from the extruded product. The data from these tests are reported in Table 2 above.

Surprisingly, the final products were predominantly unrecrystallized, as can be inferred from the relatively high strength. Therefore, fracture toughness and corrosion resistance are not expected to be compromised due to subsequent recrystallization.

The preheated material of Example 1 could not be extruded at the lower temperature used for Examples 2 and 3 without recrystallization possibly causing degradation of material properties such as significantly lower strength, lower fracture toughness and lower resistance to corrosion in the final extruded product.

EXAMPLE 4

The procedure of Examples 2 and 3 was repeated with the alloy of the present invention with the exception that the extrusion temperature was 600° F. Yield strength, ultimate tensile strength and percent elongation tests were then run on specimens taken from the extruded product. The data from these tests are reported in Table 2 above.

The preheated material of Example 1 could not be extruded at the lower temperature used for Example 4 without possibly causing recrystallization in the extrusion product which could greatly decrease the strength, toughness and corrosion resistance of the final extruded product.

EXAMPLES 5–6

Rectangular extruded bars 13.8×160.5 mm. of 2224 (Example 5), and the alloy of the present invention (Example 6) were each extruded at two different temperatures. Although the extrudate was considered to be unrecrystallized, there as an outer recrystallization layer on the surface of each. The thickness of the outer recrystallization layer was measured in the middle along the length of the extrusion for both the edge (13.8 mm) and the surface (160.5 mm) locations in the cross section. The results are shown in Table 3 below.

TABLE 3

| Extrusion Temperature | Example 5 (2224) Surface | Example 5 (2224) Edge | Example 6 (invention) Surface | Example 6 (invention) Edge |
|---|---|---|---|---|
| 650° F. | 1.3 mm | 13.8 mm* | 0.5 mm | 1.5 mm |
| 800° F. | 0.6 mm | 2.6 mm | 0.3 mm | 1.0 mm |

*full thickness partially recrystallized

Figure 2:
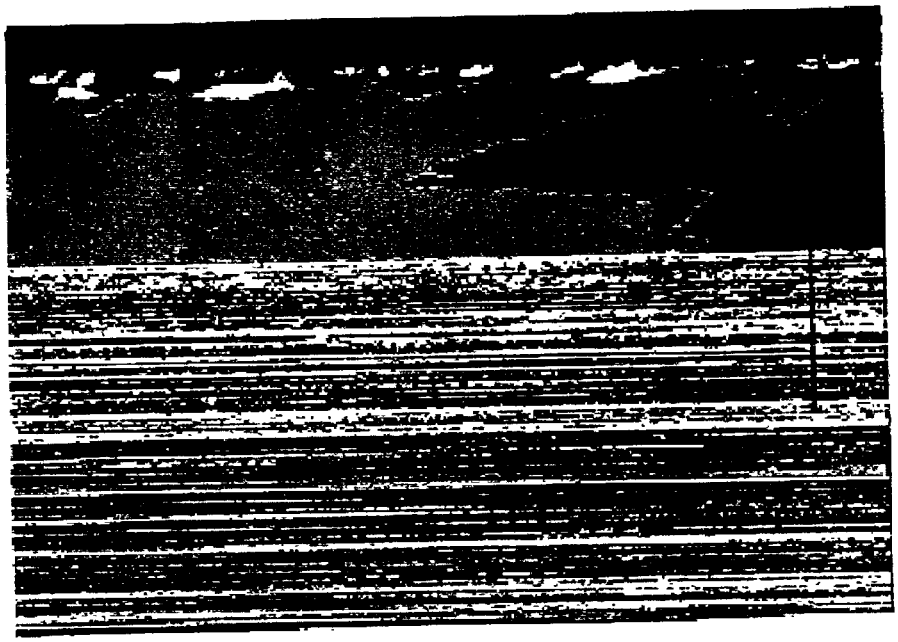
FIG. 2 is a photomicrograph of alloy produced in accordance with the present invention under the same conditions as the material of FIG. 1 showing significantly reduced surface recrystallization (by about 60%).

From Table 3 it can be seen the alloy of the present invention (Example 6) exhibited substantially less surface recrystallization at both 650° F. and 800° F. extrusion temperatures. FIGS. 1 and 2 are photomicrographs which show surface and subsurface recrystallization (as indicated with the letters A and B, respectively) of the alloys of Examples 5 and 6 at 650° F. The bars in FIGS. 1 and 2 represent 0.5 mm Recrystallization has been shown to greatly decrease the strength, toughness and corrosion resistance of the product. The greater the thickness of the recrystallization layer the greater the reduction in properties.

EXAMPLES 7–9

Rectangular extrusions having a thickness of 0.545 inches and a width of 6.3 inches were extruded at 650° F. Example 7 is unrecrystallized 2224, Example 8 is recrystallized 2224, and Example 9 is the alloy of the present invention. The property measurements were taken for the extrusions and are set forth in Table 4 below.

TABLE 4

| Property | Example Number 7 | Example Number 8 | Example Number 9 |
|---|---|---|---|
| UTS, ksi, L[1] | 75.1 | 61.8 | 76.4 |
| TYS, ksi, L[1] | 55.0 | 47.8 | 56.6 |
| S/N Fatigue, L, $K_t$ = 2.5, R = 0.1 N @ 29 ksi (log average)[2] | 112, 240 | 126, 667 | 194, 304 |
| $S_{max(net)}$, ksi @ $10^5$ cycles (estimate)[3] | 29.4 | 29.8 | 31.0 |
| Fracture toughness, L-T KR @ $\Delta a_{eff}$ = 0.34 inch, ksi✓in.[4] | 103 | 92.8 | 1079 |

Notes:
[1]Average of six 2224 round specimens or twelve round invention alloy round specimens having a diameter of 0.357 inch from front, middle and rear of extrusion
[2]Average of four double open hole fatigue specimens, t = 0.125 inch from front of extrusion
[3]S/N fatigue strength estimated from Box-Cox equation using lifetime at 29 ksi and an assumed slope
[4]Average of three 2224 specimens or six invention alloy specimens, W = 4.0 in., B = 0.45 in. from front, middle and rear of extrusion From Table 4, it can be seen that an unrecrystallized product, such as the invention alloy in Example 9, exhibits significantly higher strength as well as higher fracture toughness than one that is recrystallized. The unrecrystallized invention alloy in Example 9 demonstrates 8.8 ksi, or 18% higher yield strength, 14.6 ksi, or 24% higher tensile ultimate strength, and 15.1 ksi√in, or 16% higher fracture toughness than the recrystallized product in Example 8.

EXAMPLES 10–11

Figure 3:
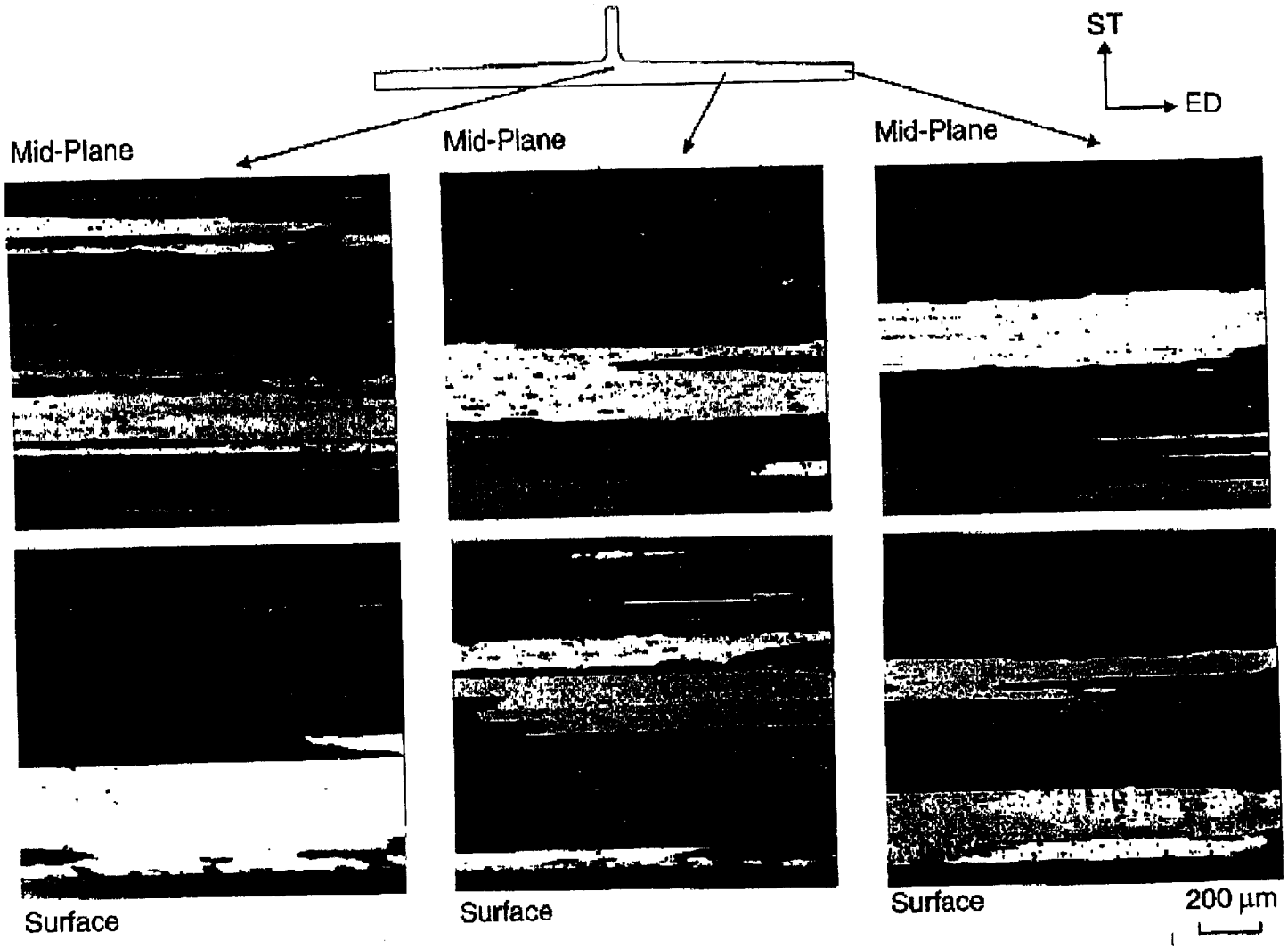
FIG. 3 is a series of six photomicrographs showing the recrystallized microstructure of AA2024-T3511 at various points in an extrusion (also shown, the actual width and thickness of the cross section are about 14 inches and 0.5 inches, respectively).
Figure 4:
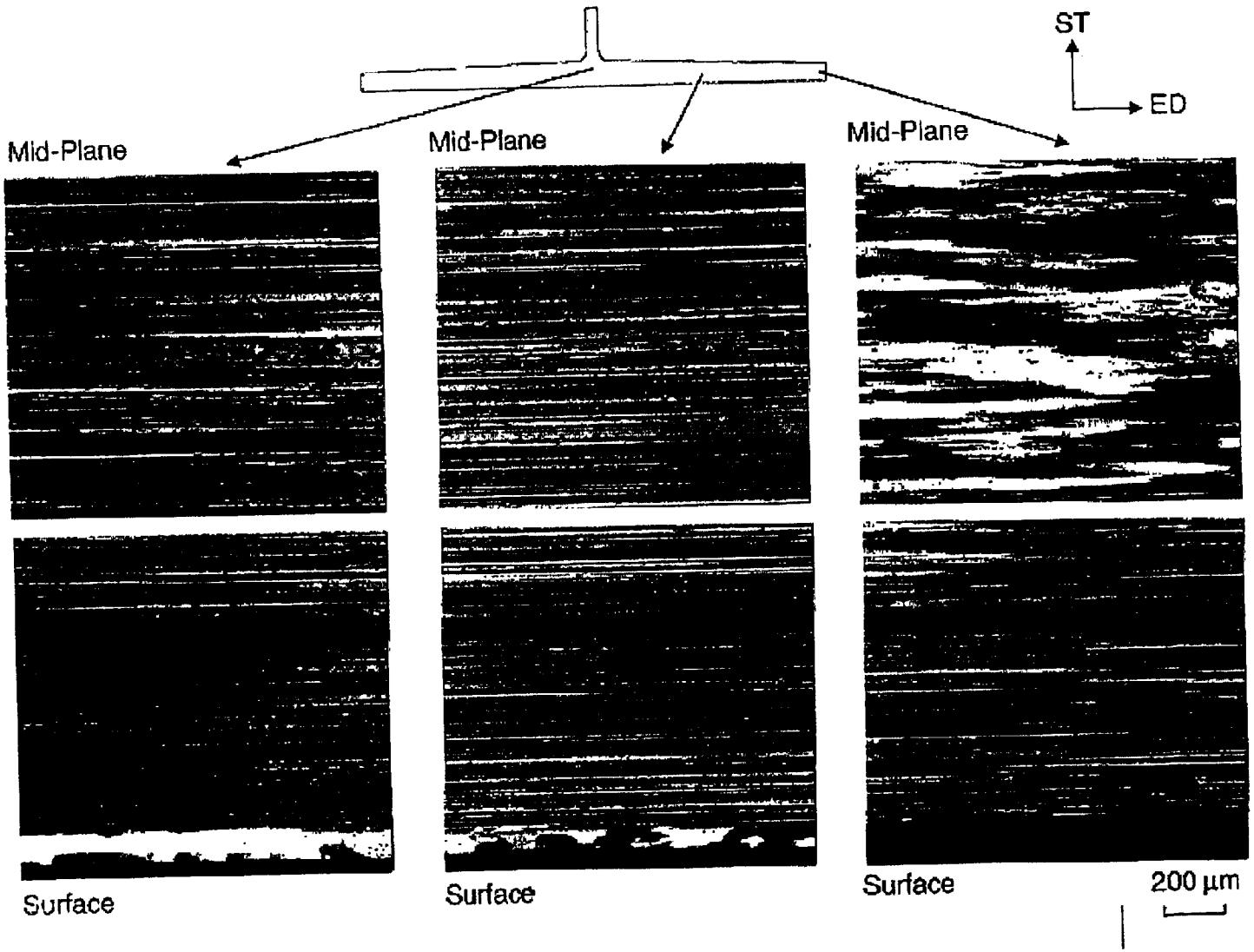
FIG. 4 is a series of six photomicrographs showing the unrecrystallized microstructure of the alloy of the present invention produced under the same conditions as the material of FIG. 3 at various points in an extrusion of the same dimensions (also shown).

Extrusions having a configuration as shown in FIGS. 3 and 4 were made from AA2024 and the alloy of the present invention. The billet temperature was 634° F. FIG. 4 shows the alloy of the present invention had only a thin surface recrystallization layer of about 0.1 mm. FIG. 3 shows the 2024 extrusion had complete recrystallization. As stated above, the greater the thickness of the recrystallization layer the greater the reduction in strength, toughness and corrosion resistance of the product.

It is to be appreciated that certain features of the present invention may be changed without departing from the present invention. Thus, for example, it is to be appreciated that although the invention has been described in terms of a preferred embodiment in which the iron and silicon levels are 0.06 wt. % and 0.08 wt. %, the iron and silicon levels comprehended by the present invention may be significantly higher. Higher levels of iron and silicon can be used in applications in which high cycle fatigue strength is non-critical.

What is believed to be the best mode of the invention has been described above. However, it will be apparent to those skilled in the art that numerous variations of the type described could be made to the present invention without departing from the spirit of the invention. The scope of the present invention is defined by the broad general meaning of the terms in which the claims are expressed.

What is claimed is:

1. A method of extruding structural members comprising:

(a) providing an alloy comprising:
about 3.6 to about 4.2 wt. % copper,
about 1.0 to about 1.6 wt. % magnesium,
about 0.3 to about 0.8 wt. % manganese,
about 0.05 to about 0.25 wt. % zirconium,
the balance substantially aluminum, incidental elements and impurities;

(b) homogenizing said alloy at a temperature between about 855° and 880° F. prior to extruding said alloy at a temperature within about 500° to about 750° F. to form an extrusion;

(c) solution heat treating said extrusion; and (d) quenching said extrusion before making a structural member therefrom.

2. The method of claim 1 wherein the extruding temperature in step (b) is about 550° to about 650° F.

3. The method of claim 1 wherein the extruding temperature in step (b) is about 600° to about 650° F.

4. The method of claim 1 which further includes:

(d) stretching said extrusion by at least about 1%.

5. A method of extruding structural members consisting essentially of:

(a) providing an alloy comprising:
about 3.6 to about 4.2 wt. % copper,
about 1.0 to about 1.6 wt. % magnesium,
about 0.3 to about 0.8 wt. % manganese,
about 0.05 to about 0.25 wt. % zirconium,
the balance substantially aluminum, incidental elements and impurities;

(b) extruding said alloy at a temperature within about 500° to about 750° F. to form an extrusion;

(c) solution heat treating said extrusion;

(d) quenching said extrusion before making a structural member therefrom; and (e) stretching said extrusion by at least about 1%.

6. The method of claim 5 which further includes:

(e) stretching said extrusion between about 1 to about 10%.

7. The method of claim 5 which further includes:

(e) stretching said extrusion between about 1 to about 8%.

8. The method of claim 5 which further includes:

(e) stretching said extrusion between about 1 to about 3%.

9. The method of claim 5 which further includes:

(e) stretching said extrusion by at least about 1%, said extrusion having less than about 50% volume recrystallized after stretching.

10. The method of claim 5 which further includes in step (e):

(e) stretching said extrusion by at least about 1%, said extrusion being substantially unrecrystallized.

11. The method of claim 5 which further includes in step (e):

(e) stretching said extrusion by at least about 1%; said extrusion leaving a longitudinal yield strength of at least about 50 ksi and a longitudinal tensile ultimate strength of at least about 70 ksi.

12. A method of extruding structural members having a combination of high strength and toughness, said method comprising:

(a) providing an alloy comprising:
about 3.6 to about 4.2 wt. % copper,
about 1.0 to about 1.6 wt. % magnesium,
about 3.6 to about 4.2 wt. % copper,
about 1.0 to about 1.6 wt. % magnesium,
about 0.3 to about 0.8 wt. % manganese,
about 0.05 to about 0.25 wt. % zirconium,
the balance substantially aluminum, incidental elements and impurities;

(b) homogenizing said alloy at a temperature between about 855° and 880° F. prior to extruding said alloy at a temperature with about 500° to about 750° F. to form an extrusion;

(c) solution heat treating said extrusion; and (d) quenching said extrusion before making a structural member therefrom.

* * * * *